US009020393B2

(12) United States Patent
Tomatsu

(10) Patent No.: US 9,020,393 B2
(45) Date of Patent: Apr. 28, 2015

(54) IMAGE FORMING APPARATUS

(71) Applicant: Yoshiya Tomatsu, Kasugai (JP)

(72) Inventor: Yoshiya Tomatsu, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 43 days.

(21) Appl. No.: 14/041,401

(22) Filed: Sep. 30, 2013

(65) Prior Publication Data

US 2014/0126929 A1 May 8, 2014

(30) Foreign Application Priority Data

Nov. 2, 2012 (JP) ..... 2012-243046

(51) Int. Cl.
*G03G 21/16* (2006.01)

(52) U.S. Cl.
CPC ..... *G03G 21/16* (2013.01)

(58) Field of Classification Search
CPC ..... G03G 21/16; G03G 21/1652
USPC ..... 399/110, 107, 90
See application file for complete search history.

(56) References Cited

U.S. PATENT DOCUMENTS

| | | | | |
|---|---|---|---|---|
| 6,079,816 | A * | 6/2000 | Nakamura et al. | |
| 7,076,187 | B2 * | 7/2006 | Jeong et al. | 399/110 |
| 7,366,437 | B2 | 4/2008 | Inui et al. | |
| 7,826,766 | B2 | 11/2010 | Okabe | |
| 8,831,479 | B2 * | 9/2014 | Arikawa et al. | 399/110 |
| 2006/0171727 | A1 | 8/2006 | Inui et al. | |
| 2008/0181658 | A1 | 7/2008 | Okabe | |
| 2009/0092414 | A1 | 4/2009 | Tomatsu | |
| 2010/0080615 | A1 | 4/2010 | Kikuchi | |
| 2012/0076527 | A1 | 3/2012 | Goto | |

FOREIGN PATENT DOCUMENTS

| | | | |
|---|---|---|---|
| JP | 2002-131997 | A | 5/2002 |
| JP | 2006-215203 | A | 8/2006 |
| JP | 2008-185830 | A | 8/2008 |
| JP | 2009-092859 | A | 4/2009 |
| JP | 2010-102350 | A | 5/2010 |
| JP | 2012-073491 | A | 4/2012 |

* cited by examiner

*Primary Examiner* — Susan Lee
(74) *Attorney, Agent, or Firm* — Banner & Witcoff, Ltd.

(57) ABSTRACT

An image forming apparatus, comprising: a housing having an opening; a drawer member to support photosensitive drums disposed to have intervals therebetween to be parallel with each other and to be movable in an arrangement direction of the photosensitive drums such that the drawer member moves between an attached position where the drawer member is attached in the housing and a drawn position where the drawer member is drawn to an outside of the housing; and a presser member that is provided in the housing and is configured to press the drawer member toward one side in an axial direction each photosensitive drum, wherein the presser member presses a downstream end part of the drawer member defined in a moving direction of the drawer member, at a position overlapping with the photosensitive drums in the arrangement direction, in a state where the drawer member is at the attached position.

9 Claims, 10 Drawing Sheets

IMAGE FORMING APPARATUS

CROSS-REFERENCE TO RELATED APPLICATION

This application claims priority under 35 U.S.C. §119 from Japanese Patent Application No. 2012-243046, filed on Nov. 2, 2012. The entire subject matter of the application is incorporated herein by reference.

BACKGROUND

1. Technical Field

Aspects of the present invention relate to an image forming apparatus of an electrophotographic type.

2. Related Art

As an image forming apparatus of an electrophotographic type, a color laser printer of a tandem type having a plurality of photosensitive drums disposed respectively for yellow, magenta, cyan and black to be parallel with each other is known. For example, a printer comprising a body casing in which a positioning part is provided and a drum support member in which a plurality of photosensitive drums are disposed in the front and rear direction to be parallel with each other is known. In this printer, the drum support member is attached to the body casing such that the drum support member can be drawn from the body casing.

In such a printer, a positioning recessed part formed in the drum support member engages with a positioning member provided in the body casing in a state where the drum support member is attached to the body casing, so that the drum support member is positioned with respect to the body casing in the front and rear direction.

SUMMARY

However, in such a printer, there is a case where the positioning accuracy of the drum support member with respect to the body casing cannot be adequately secured in regard to the left and right direction, i.e., an axial direction in which an axis of each photosensitive drum extends. Therefore, there is a case where the positioning accuracy of the photosensitive drums provided in the drum support member with respect to the body casing in the axial direction cannot be adequately secured and thereby image formation failure occurs.

Aspects of the present invention are advantageous in that they provide an image forming apparatus configured to enhance the positioning accuracy in an axial direction of a plurality of photosensitive drums with respect to a housing, while securing smooth movement of a drawer member between a drawn position and an attached position.

According to an aspect of the invention, there is provided an image forming apparatus, comprising: a housing having an opening; a drawer member configured to support a plurality of photosensitive drums disposed to have intervals therebetween to be parallel with each other, and to be movable in an arrangement direction of the plurality of photosensitive drums such that the drawer member moves between an attached position where the drawer member is attached in the housing and a drawn position where the drawer member is drawn to an outside of the housing from the attached position via the opening; and a presser member that is provided in the housing and is configured to press the drawer member toward one side in an axial direction in which an axis of each of the plurality of photosensitive drums extends. In this configuration, the presser member presses a downstream end part of the drawer member defined in a moving direction of the drawer member pointing from the drawn position to the attached position, at a position overlapping with the plurality of photosensitive drums in the arrangement direction, in a state where the drawer member is situated at the attached position.

According another aspect of the invention, there is provided an image forming apparatus, comprising: a housing having an opening; a drawer member configured to support a plurality of photosensitive drums disposed to have intervals therebetween to be parallel with each other, and to move between an attached position where the drawer member is attached in the housing and a drawn position where the drawer member is drawn to an outside of the housing from the attached position via the opening; a presser member that is provided in the housing and is configured to press the drawer member toward one side in an axial direction in which an axis of each of the plurality of photosensitive drums extends, wherein the presser member presses a downstream end part of the drawer member defined in a moving direction of the drawer member pointing from the drawn position to the attached position, in a state where the drawer member is situated at the attached position; and an electrode member that is provided in the housing and is configured to electrically connected to the drawer member situated at the attached position. In this configuration, wherein the electrode member comprises: a first electrode disposed on one side in an orthogonal direction orthogonal to both of the axial direction and the moving direction of the drawer member pointing from the drawn position to the attached position, with respect to the presser member, in the state where the drawer member is situated at the attached position; and a second electrode disposed on the other side in the orthogonal direction, with respect to the presser member, in the state where the drawer member is situated at the attached position.

BRIEF DESCRIPTION OF THE ACCOMPANYING DRAWINGS

FIG. 10A illustrates a state where the shutter is at the detection position and FIG. 10B illustrates a state where the shutter is at the non-detection position.

DETAILED DESCRIPTION

Hereafter, an embodiment according to the invention will be described with reference to the accompanying drawings.

1. General Configuration of Printer

Figure 1:
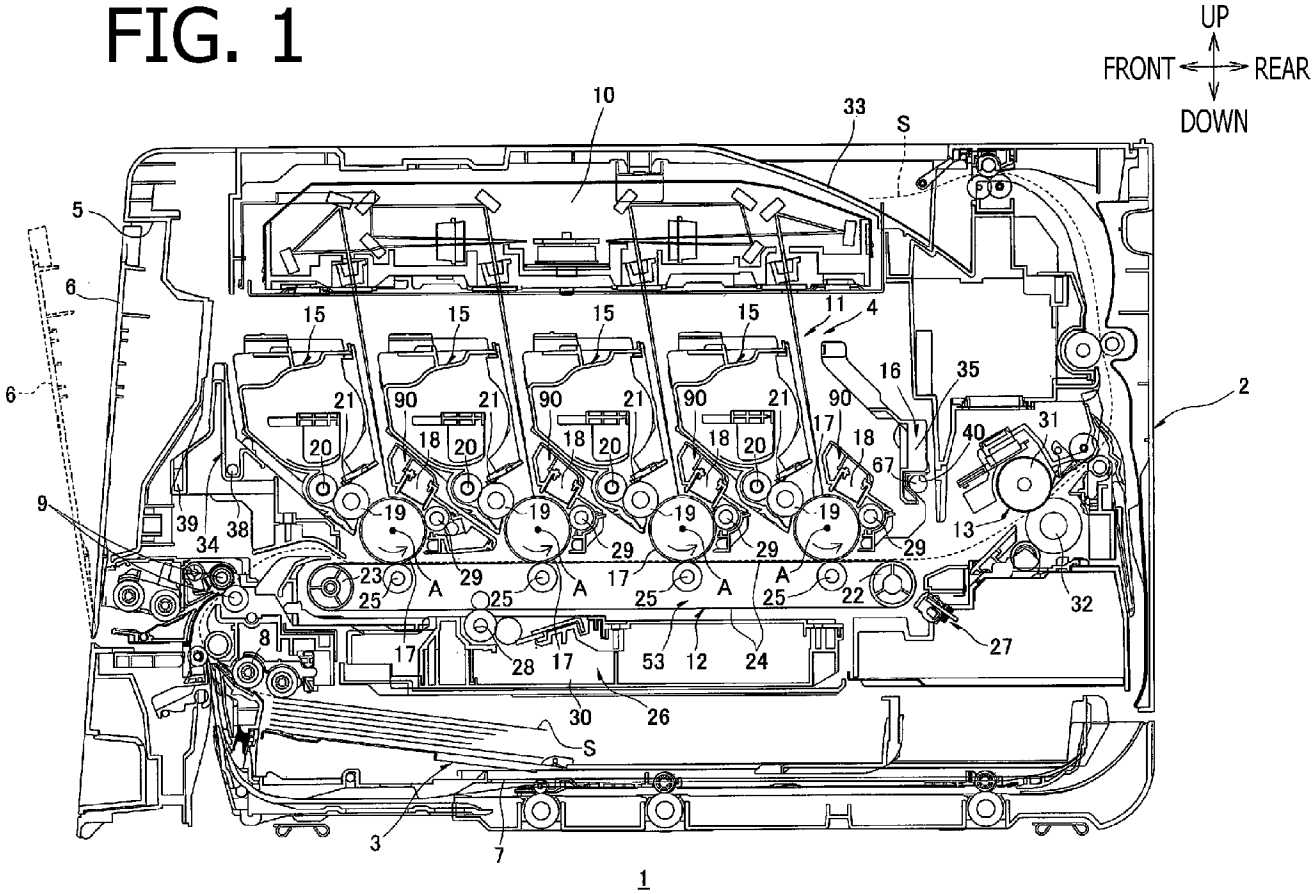
FIG. 1 illustrates a central cross section of a printer according to an embodiment.

As shown in FIG. 1, a printer 1 provided as an example of an image forming apparatus is a color printer of a horizontal direct tandem color type.

The printer 1 includes a paper supply unit 3 configured to supply a sheet S and an image formation unit 4 configured to form an image of the supplied sheet S in a main body casing 2 which is an example of a housing.

(1) Main Body Casing

The main body casing 2 is formed in a shape of a box having a rectangular shape when viewed as a side view, and is configured to accommodate therein the paper supply unit 3 and the image formation unit 4. On one side of the main body casing 2, an opening 5 for pulling out a drum frame 16 which is described later is formed, and a front cover 6 for opening and closing the opening 5 is provided.

In the following explanation, a side on which the front cover 6 is provided is defined as a front side, and the opposite side is defined as a rear side. The left and right sides are defined when the printer 1 is viewed from the front side. That is, the left side on the paper face of FIG. 1 is defined as the front side, the right side on the paper face of FIG. 1 is defined as the rear side, the forehand side with respect to the paper face of FIG. 1 is defined as the right side, and the back side defined with respect to the paper face of FIG. 1 is defined as the left side. Regarding the drum frame 16 which is described later, the front, rear, left, right, upward and downward directions are defined with respect to a state where the drum frame 16 is attached to the main body casing 2.

The left and right direction is an example of an axial direction, the left side is one side in the axial direction, and the right side is the other side in the axial direction. The front and rear direction is an example of an arrangement direction, the front side is one side in the arrangement direction, and the rear side is the other side in the arrangement direction. The up and down direction is an example of an orthogonal direction, the upper side is one side in the orthogonal direction, and the lower side is the other side in the orthogonal direction.

The front cover 6 is provided to be swingable about a lower end thereof as a supporting point between a closed position where the opening 5 is closed and an opened position where the opening 5 is opened. The front cover 6 represented by a virtual line shows a situation where the front cover 6 is situated between the closed position and the opened position.

(2) Paper Supply Unit and Image Formation Unit

The paper supply unit 3 accommodates the sheets S, and includes a paper supply tray 7 which is detachably attachable to a bottom part of the main body casing 2. The image formation unit 4 is disposed on the upper side of the paper supply tray 7, and includes a scanner unit 10, a process unit 11, a transfer unit 12 and a fixing unit 13.

The scanner unit 10 is disposed at an upper end portion in the main body casing 2. As indicated by solid lines, the scanner unit 10 emits laser beams based on image data to a plurality of photosensitive drums 17, respectively, to expose the photosensitive drums 17.

The process unit 11 is disposed on the lower side of the scanner unit 10, and includes a drum frame 16 and development cartridges 15. The drum frame 16 includes the photosensitive drums 17, scorotron chargers 18 and drum cleaning rollers 29.

The photosensitive drums 17 are provided for a plurality of colors, i.e., yellow, magenta, cyan and black. That is, four photosensitive drums 17 are provided. The photosensitive drums 17 are disposed in parallel with each other to have constant intervals therebetween in the front and rear direction, on the upper side of the paper supply tray 17.

The scorotron chargers 18 are provided respectively for the plurality of photosensitive drums 17, and each scorotron charger 18 is disposed to face the corresponding photosensitive drum 17 to have a certain interval therebetween. The drum cleaning rollers 29 are provided respectively for the plurality of photosensitive drums 17, and each drum cleaning roller 29 is disposed to contact the corresponding photosensitive drum 17 from the rear side.

The development cartridges 15 are provided respectively for the plurality of photosensitive drums 17, and each development cartridge 15 is disposed on the upper front side of the corresponding photosensitive drum 17. The development cartridge 15 includes a development roller 19. The development roller 19 is disposed to be exposed from the lower rear side at a lower end portion of the development cartridge 15, and contacts the photosensitive drum 17 from the upper front side.

The development cartridge 15 includes a supply roller 20 which supplies toner to the development roller 19, and a layer limit blade 21 which limits the thickness of toner supplied to the development roller 19. The development cartridge 15 stores the toner (which is an example of a developer) on the upper side of the supply roller 20 and the layer limit blade 25.

The transfer unit 12 is provided to extend in the front and rear direction on the upper side of the paper supply tray 17 and the lower side of the plurality of photosensitive drum 17. The transfer unit 12 includes a belt unit 53 and a belt cleaner 26. The belt unit 53 includes a drive roller 22, a driven roller 23, a conveying belt 24 which is an example of a belt member, and transfer rollers 25. The drive roller 22 and the driven roller 23 are disposed to face with each other to have an interval therebetween in the front and rear direction.

The conveying belt 24 is provided to extend between the drive roller 22 and the driven roller 23, while facing the photosensitive drums 17 from the lower side so that the upper part of the conveying belt 24 contacts the photosensitive drums 17. In accordance with driving of the drive roller 22 and the driven roller 23, the conveying belt 24 circularly moves so that the upper part of the conveying belt 24 contacting the photosensitive drums 17 moves from the front side to the rear side.

A plurality of transfer rollers 25 are provided respectively for the plurality of photosensitive drums 17. That is, four transfer rollers 25 are provided. The four transfer rollers 25 are provided to face the respective photosensitive drums 17 while sandwiching the upper part of the conveying belt 24 the transfer rollers 25 and the photosensitive drums 17.

The belt cleaner 26 is disposed under the belt unit 53. After the toner adhered to a surface of the conveying belt 24 (i.e., waste toner) is cleaned by a belt cleaning roller 28, the toner is scraped off and is stored in a waste toner accommodation unit 30. The fixing unit 13 is disposed on the rear side of the transfer unit 12, and includes a heat roller 31 and a pressure roller 32 pressed against the heat roller 31.

(3) Image Formation (3-1) Development

The toner in the development cartridge 15 is supplied to the supply roller 20, and is further supplied to the development roller 19. Then, the toner is charged positively by friction between the supply roller 20 and the development roller 19.

The thickness of the toner supplied to the development roller 19 is limited by the layer limit blade 21 in accordance with rotation of the development roller 19, and the toner is held on the surface of the development roller 19 as a thin layer having a constant thickness.

After the surface of the photosensitive drum 17 is charged uniformly by the scorotron charger 18, the surface of the photosensitive drum 17 is exposed by the scanner unit 10 based on the image data. As a result, an electrostatic latent image based on the image data is formed on the surface of the photosensitive drum 17. Then, the toner held on the development roller 19 is supplied to the electrostatic latent image on the surface of the photosensitive drum 17 in accordance with rotation of the development roller 19. Thus, a toner image is held on the outer circumferential surface of the photosensitive drum 17.

(3-2) Paper Supply

The sheet S accommodated in the paper supply tray 7 is supplied one by one toward a pair of registration rollers 9 by rotation of a paper supply roller 8. Then, the sheet S is conveyed to the image formation unit 4 by rotation of the registration rollers 9 at predetermined timings, and is supplied to a position between the photosensitive drums 17 and the conveying belt 24.

The sheet S supplied to the portion between the photosensitive drums 17 and the conveying belt 24 is then conveyed from the front side to the rear side by the conveying belt 24. Toner images having respective colors are sequentially transferred to the sheet S while the sheet S passes through the portion between the photosensitive drums 17 and the transfer roller 25. As a result, a color image is formed on the sheet S.

(3-3) Fixing and Discharge

The sheet S to which the color image has been transferred is then conveyed to a position between the heat roller 31 and the pressure roller 32, and the sheet S is heated and pressurized while the sheet S passes through the position between the heat roller 31 and the pressure roller 32. As a result, the color image transferred on the sheet S is thermally fixed. Then, the sheet S is conveyed upwardly to the front side while making a U-turn, and is discharged to a discharge tray 33 formed on the top surface of the main body casing 2.

2. Details about Process Unit

As described above, the process unit 11 includes the drum frame 16.

Figure 2:
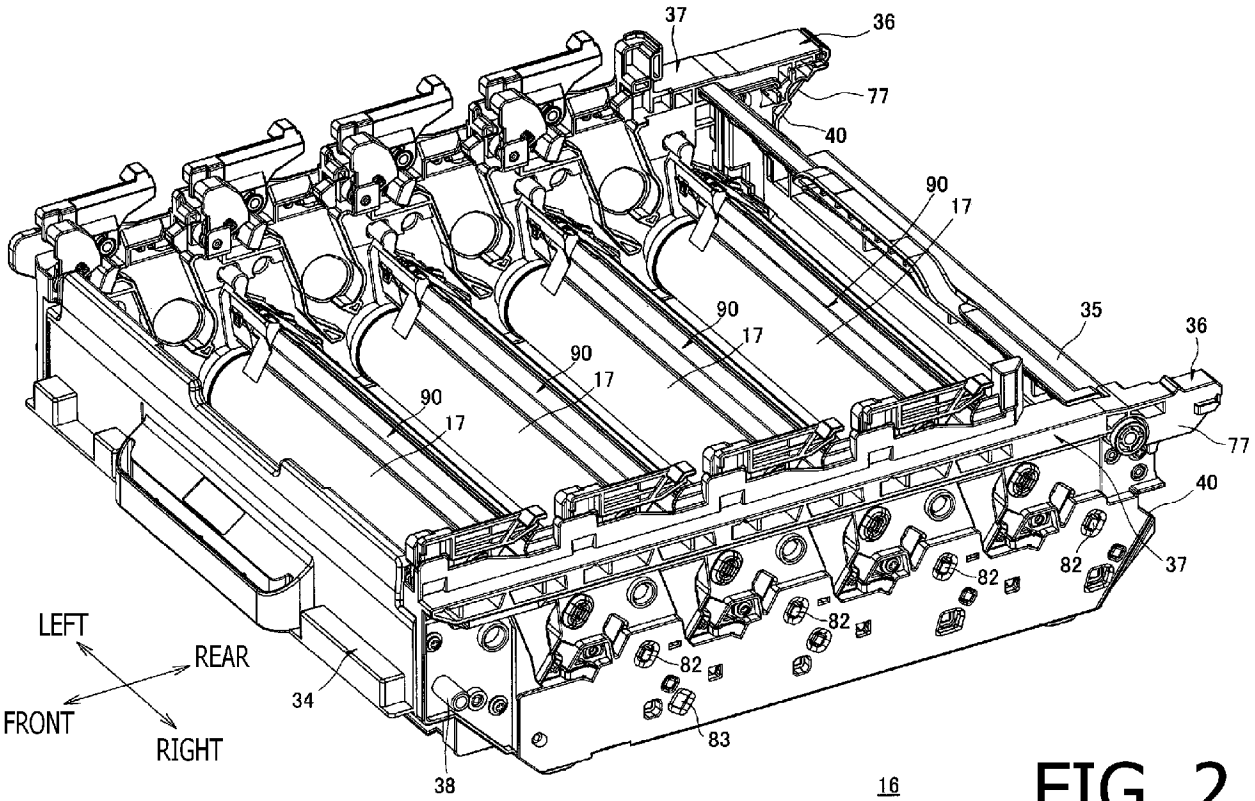
FIG. 2 is a perspective view of a drum frame shown in FIG. 1 viewed from an upper right side.
Figure 5:
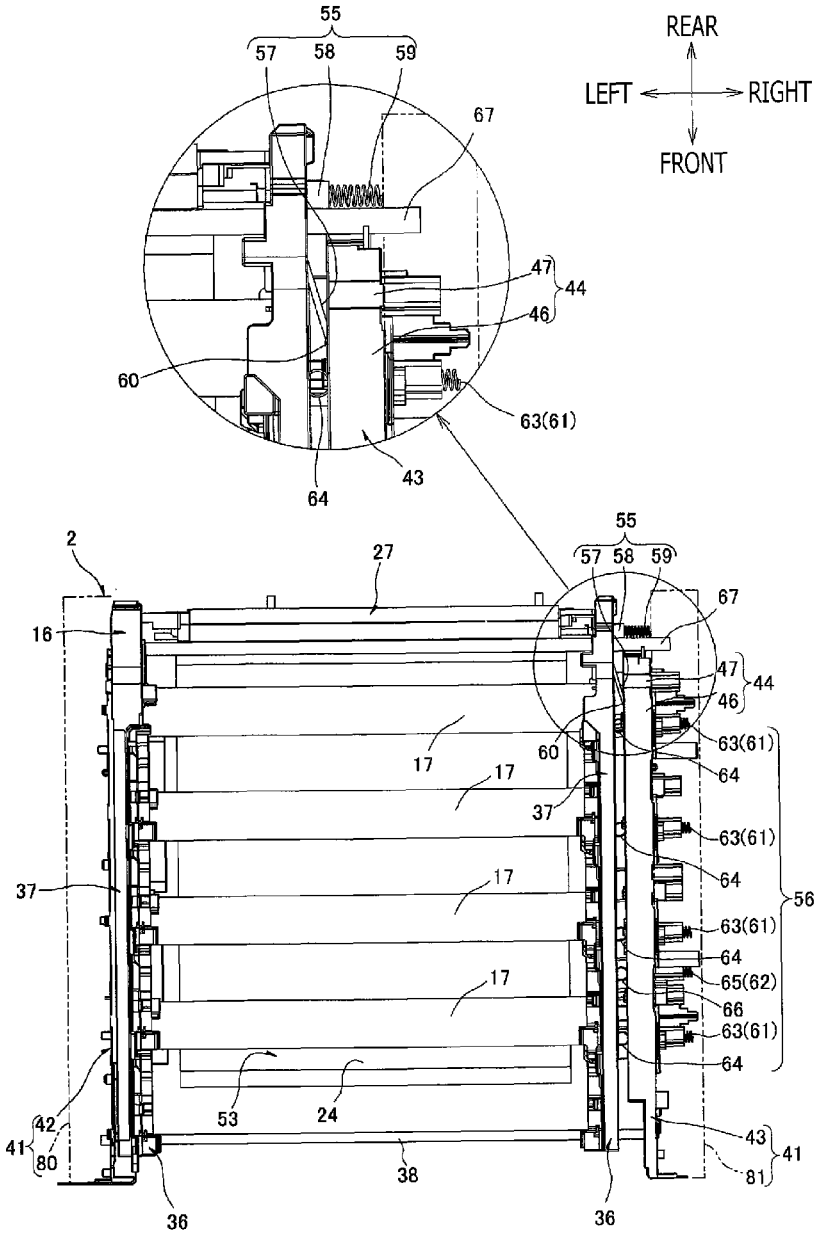
FIG. 5 is an explanatory illustration for explaining attachment and drawing of the drum frame shown in FIG. 2 with respect to a main body casing, illustrating a state where the drum frame is at the attached position.
Figure 6:
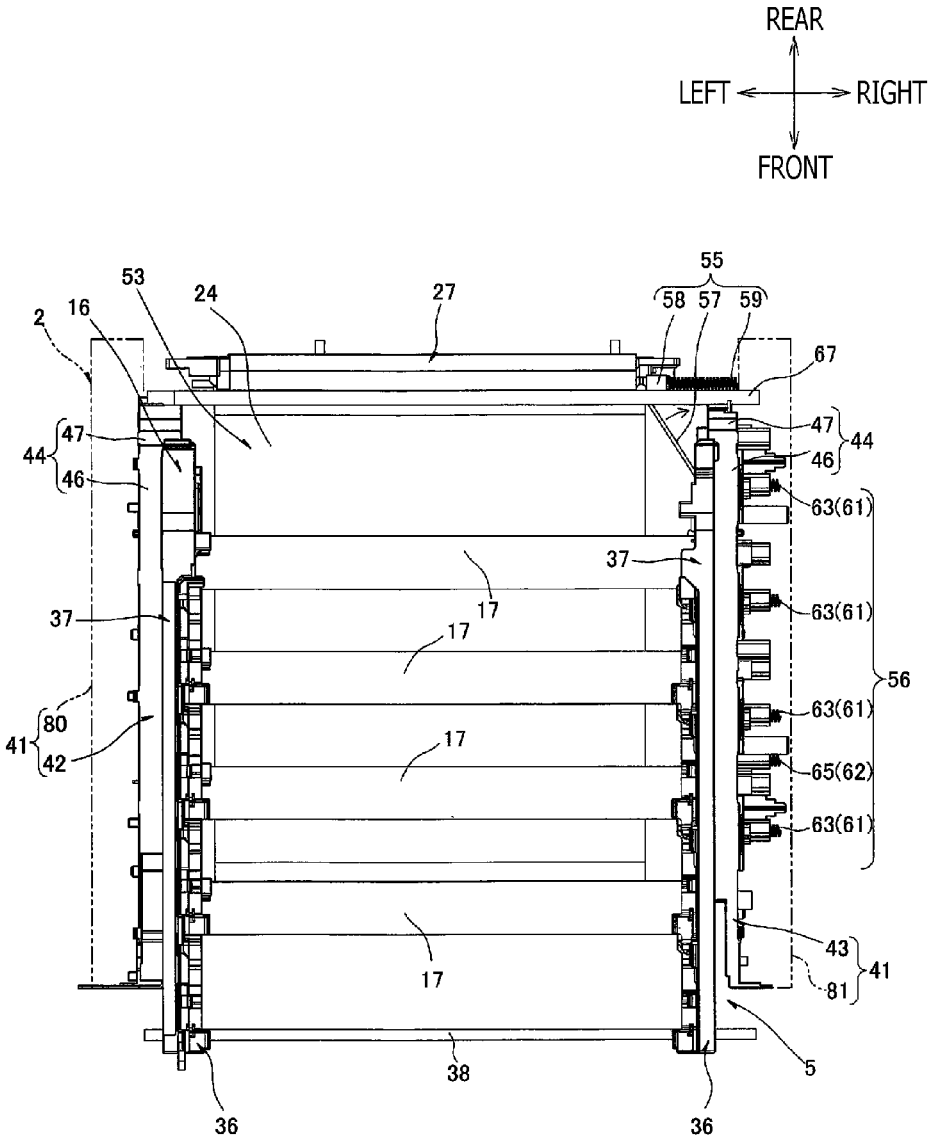
FIG. 6 is an explanatory illustration for explaining, subsequently to FIG. 5, the attachment and drawing of the drum frame with respect to the main body casing, illustrating a state where the drum frame is at a midway point of the movement.
Figure 7:
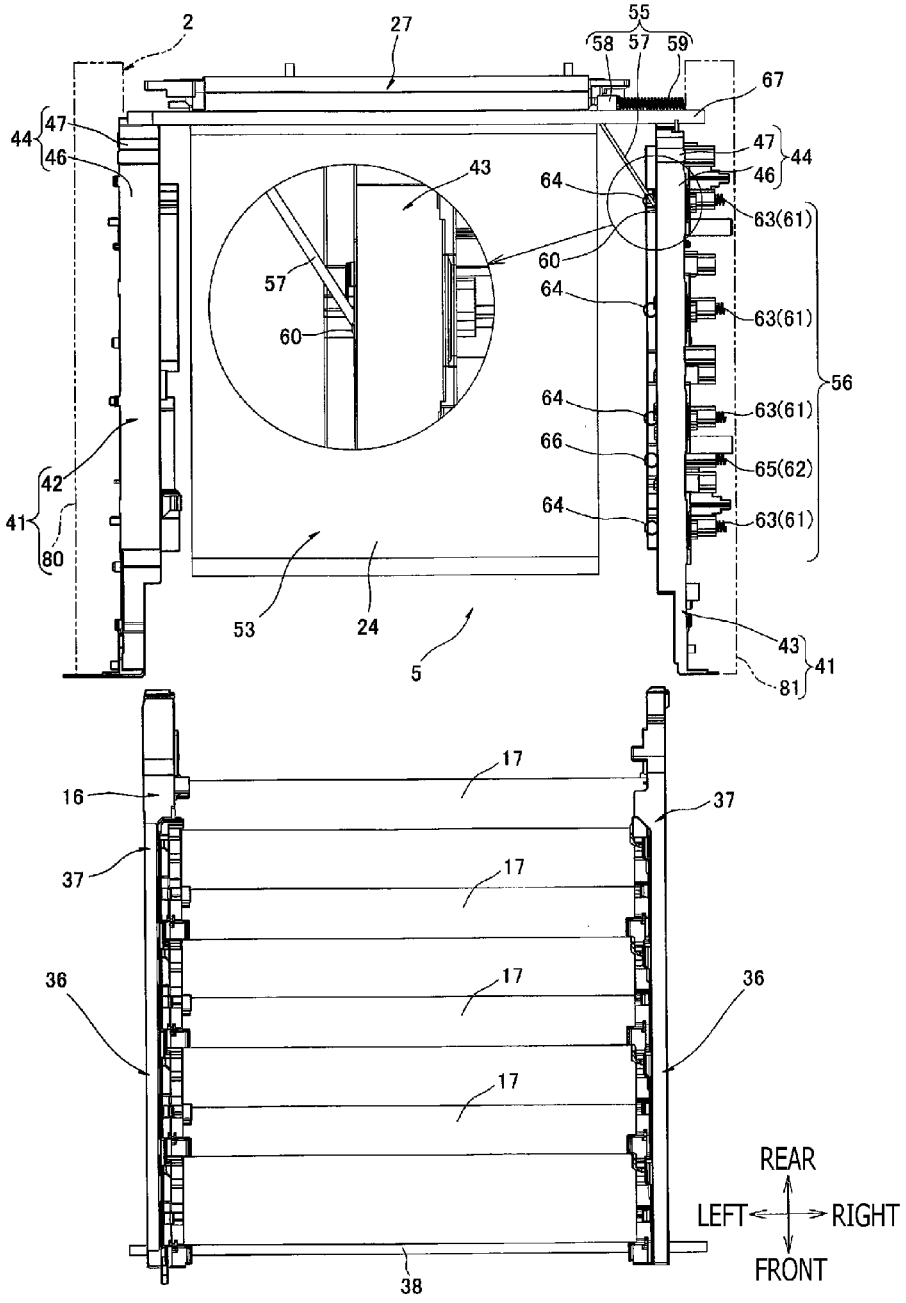
FIG. 7 is an explanatory illustration for explaining, subsequently to FIG. 6, the attachment and drawing of the drum frame with respect to the main body casing, illustrating a state where the drum frame is at a drawn position.

As shown in FIG. 2, the drum frame 16 is formed in a rectangular shape elongated in the front and rear direction when viewed as a plan view. As described in detail below, the drum frame 16 is formed to be slidable between an attached position where the drum frame 16 is attached to the main body casing 2 and a drawn position where the drum frame 16 is drawn to the outside the main body casing 2 from the attached position through the opening 5 as shown in FIGS. 5 to 7. In the following, explanation is made with reference to a situation where the drum frame 16 is at the attached position shown in FIGS. 1, 3-5 and 8-10A.

As shown in FIG. 2, the drum frame 16 includes a pair of side plates 36, a front beam 34 and a rear beam 35. The pair of side plates 36 is disposed to face with each other to have an interval therebetween in the left and right direction.

Figure 3:
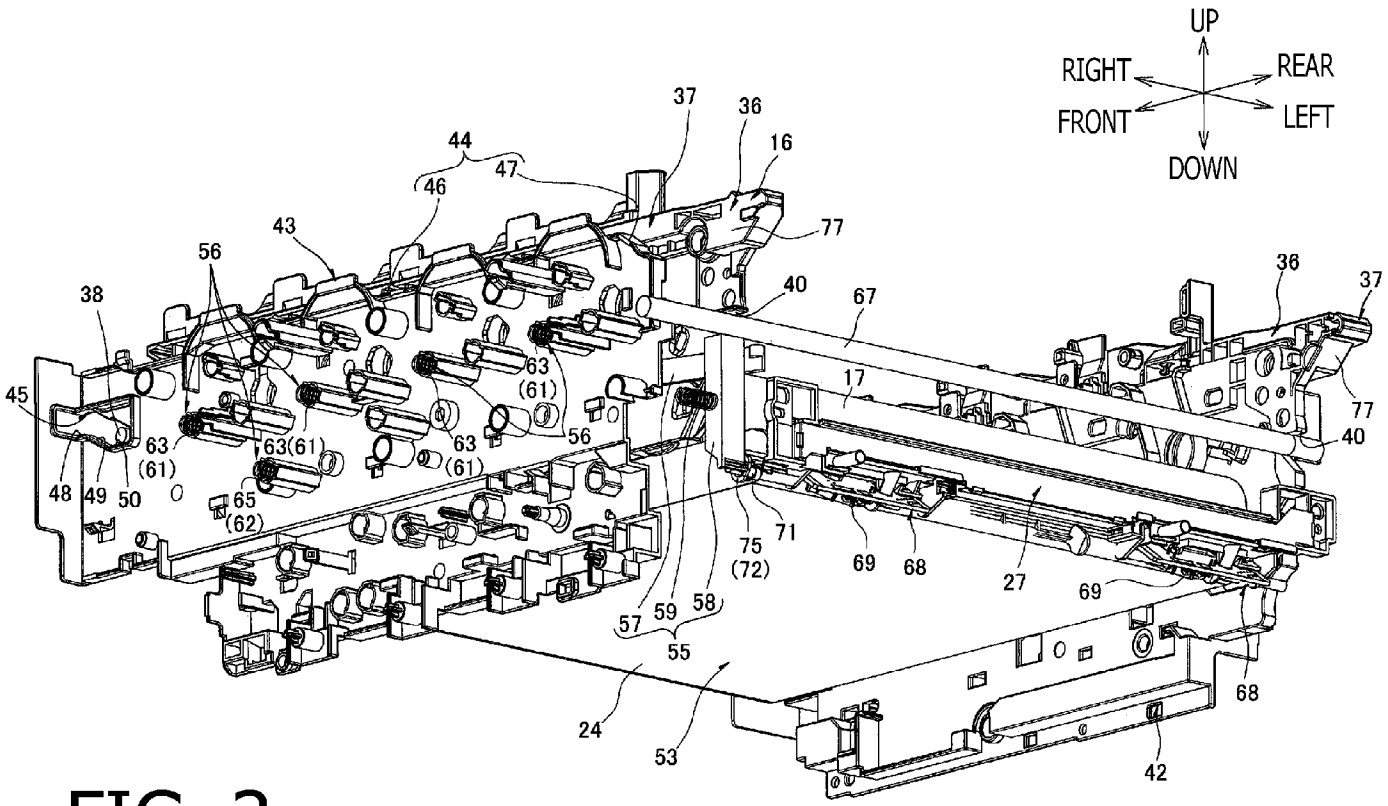
FIG. 3 is a perspective view of the drum frame shown in FIG. 2 situated at an attached position, illustrating from the lower right side.

Each of the pair of side plates 36 is formed to be a flat plate having a rectangular shape extending in the front and rear direction when viewed as a side view. A cutout 40 is formed at a rear end part of each of the side plates 36. The cutout 40 is formed in a shape of a letter V when viewed as a side view such that the rear end part of the side plate 36 is cut out from the central portion of the rear end portion in the up and down direction toward the front side. As shown in FIGS. 1 and 3, in the state where the drum frame 16 is at the attached position, the cutout 40 receives a main body reference shaft 67 and contacts the main body reference shaft 69 from the upper side and from the lower front side.

As shown in FIG. 3, each of the pair of side plates 36 is integrally provided with a drum side rail part 37. The drum side rail part 37 is formed in a shape of a rod. Specifically, the drum side rail part 37 is formed to protrude outwardly in the left and right direction from the upper edge of the outside surfaces of the side plates 36 in the left and right direction, and further is formed to extend in the front and rear direction over the entire length of the side plates 36.

Each drum side rail part 37 is integrally provided with a projection 77. The projection 77 is formed to protrude downwardly from the rear end on the lower surface of the drum side rail part 37 to have a rectangular shape when viewed as a side view. Furthermore, the rear end of the projection 77 is cut off so that the rear surface of the projection 77 is inclined to the upper rear side, and the front end of the projection 77 is cut off so that the front surface of the projection 77 is inclined to the upper front side. In the state where the drum frame 16 is at the attached position, the projection 77 is positioned on the rear side with respect to a second guide surface 47 of a guide part 44 which is described later.

As shown in FIG. 2, a scorotron relay electrode 82 and a cleaning relay electrode 83 are provided to be buried in the right side plate 36.

A plurality of scorotron relay electrodes 82, i.e., four scorotron relay electrodes 82, are provided respectively for the plurality of scorotron chargers 18. The plurality of scorotron relay electrodes 82 are disposed to have intervals therebetween in the front and rear directions, and are buried in the right side plate 36 such that the plurality of scorotron relay electrodes 82 are exposed when viewed from the right side. The cleaning relay electrode 83 is provided on the lower rear side of the forefront scorotron relay electrode 82, and is buried in the right side plate 36 such that the cleaning relay electrode 83 is exposed when viewed from the right side.

The front beam 34 is formed in a shape of a flat plate and has a rectangular shape extending in the left and right direction when viewed as a front view. The front beam 34 is installed at the front edge portion of the pair of side plates 36. The rear beam 35 is formed in a shape of a flat plate and has a rectangular shape extending in the left and right direction when viewed as a rear view, and is installed between the rear edges of the pair of side plates 36.

The drum frame 16 supports the plurality of photosensitive drums 17, a plurality of drum subunits 90 and a drum side reference shaft 38.

The plurality of photosensitive drums 17 are disposed between the lower portions of the pair of side plates 36, and are arranged to have constant intervals therebetween and to be parallel with each other. Specifically, when projected in the left and right direction, the plurality of photosensitive drums 17 are disposed on the lower front positions of the respective scorotron relay electrodes 82. Further, when projected in the left and right direction, the forefront photosensitive drum 17 is disposed on the front side of the cleaning relay electrode 83, and the second photosensitive drum 17 from the front side is disposed on the rear side of the cleaning relay electrode 83.

The photosensitive drum 17 is formed in a cylindrical shape extending in the left and right direction. The photosensitive drum 17 is supported by the drum frame 16 such that left and right ends thereof are rotatably supported by the pair of side plates 36. As a result, as shown in FIG. 1, when a driving force from a driving source, such as a motor, provided in the main body casing 2 is transmitted thereto, the photosensitive drum 17 rotates in the counterclockwise direction about an axis A extending in the left and right direction when viewed as a right side view.

As shown in FIG. 2, each drum subunit 90 is formed to extend in the left and right direction, and is disposed on the upper rear side of the corresponding photosensitive drum 17 between the pair of side plates 36. The drum subunits 90 are arranged to have constant intervals therebetween and to be in parallel with each other. As shown in FIG. 1, the drum subunit 90 supports the scorotron charger 18 and the drum cleaning roller 29. Furthermore, as shown in FIG. 2, the drum subunit 90 is supported by the drum frame 16 such that the left and right ends thereof are respectively fixed to the pair of side plates 36.

The scorotron charger 18 is electrically connected to the corresponding scorotron relay electrode 82. The drum cleaning roller 29 is electrically connected to the cleaning relay electrode 83 via a wiring (not shown).

The drum side reference shaft 38 is formed in a cylindrical shape extending in the left and right direction, and is disposed to penetrate through the front beam 34 and the front end parts of the pair of side plates 36. The left and right ends of the drum side reference shaft 38 protrude outward from the front end parts of the side plates 36. As shown in FIG. 3, in the state where the drum frame 16 is at the attached position, the left and right ends of the drum side reference shaft 38 are respectively received by the rear edges of reference shaft insertion grooves 45 which are described later, and contact the lower edges of the reference axis insertion grooves 45.

The development cartridges 15 are detachably attachable to the drum frame 16 on the upper front side of the respective photosensitive drums 17.

3. Details about Main Body Casing

As shown in FIG. 7, the main body casing 2 includes a pair of side walls 41 disposed to have an interval therebetween in the left and right direction. The left side wall 41 includes a first frame 42 and a first support frame 80 disposed on the left side of the first frame 42. The right side wall 41 includes a second frame 43 and a second support frame 81 disposed on the right side of the second frame 43.

As shown in FIG. 5, the first frame 42 and the second frame 43 are disposed to have an interval therebetween in the left and right direction so that the drum frame 16 disposed at the attached position is sandwiched therebetween. Specifically, the first frame 42 is disposed on the left side with respect to the drum frame 16 disposed at the attached position, and the second frame 43 is disposed on the right side with respect to the drum frame 16 disposed at the attached position.

(1) Side Wall

Figure 8:
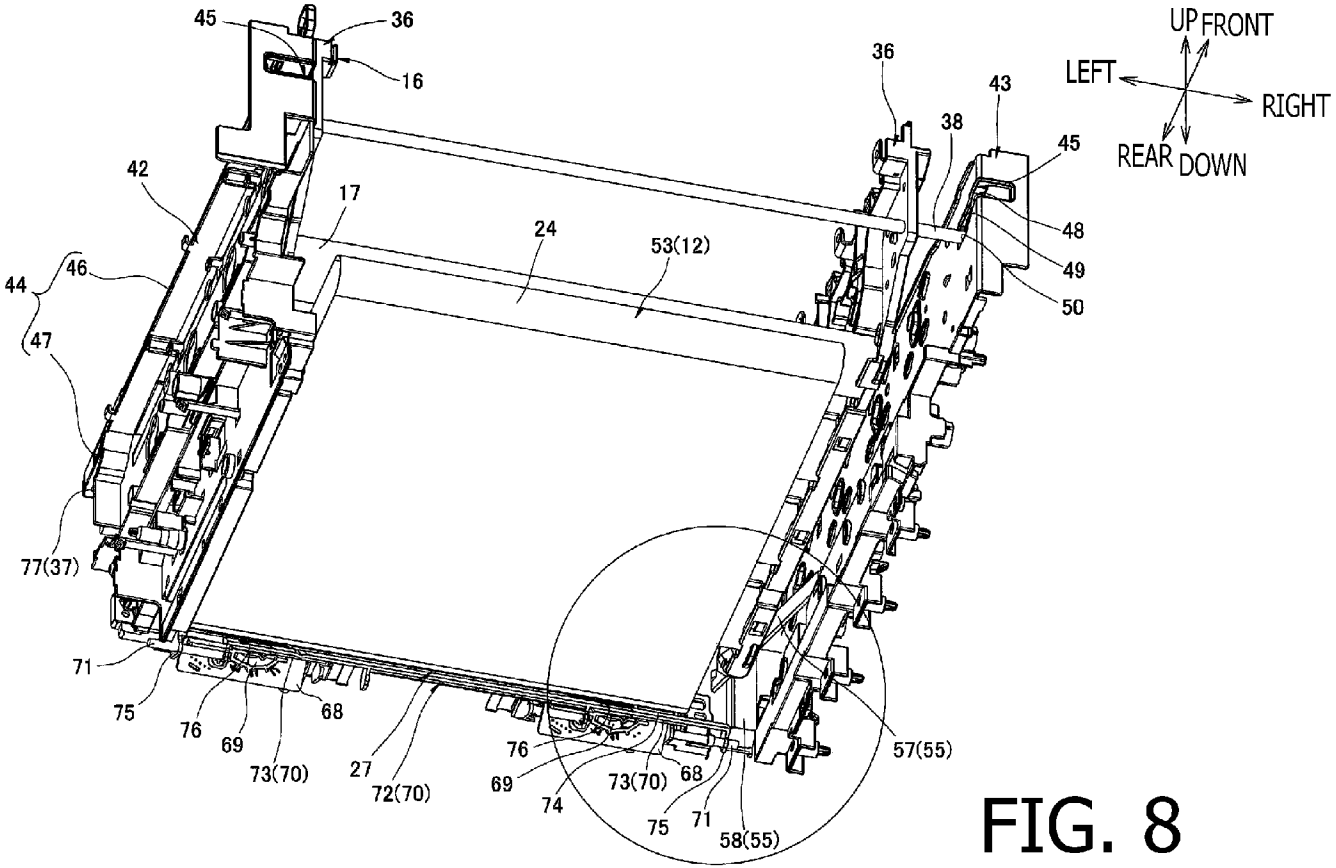
FIG. 8 is a perspective view of the drum frame shown in FIG. 3 situated at the attached position, illustrating from the lower front side.

As shown in FIG. 8, the first frame 42 is made of metal, such as, galvanized sheet iron, and is formed in a shape of a flat plate and has a rectangular shape extending in the front and rear direction when viewed as a side view. The second frame 43 is made of resin, such as, acrylonitrile-butadiene-styrene resin, and is formed in a shape of a flat plate and has a rectangular shape extending in the front and rear direction when viewed as a side view.

Figure 4:
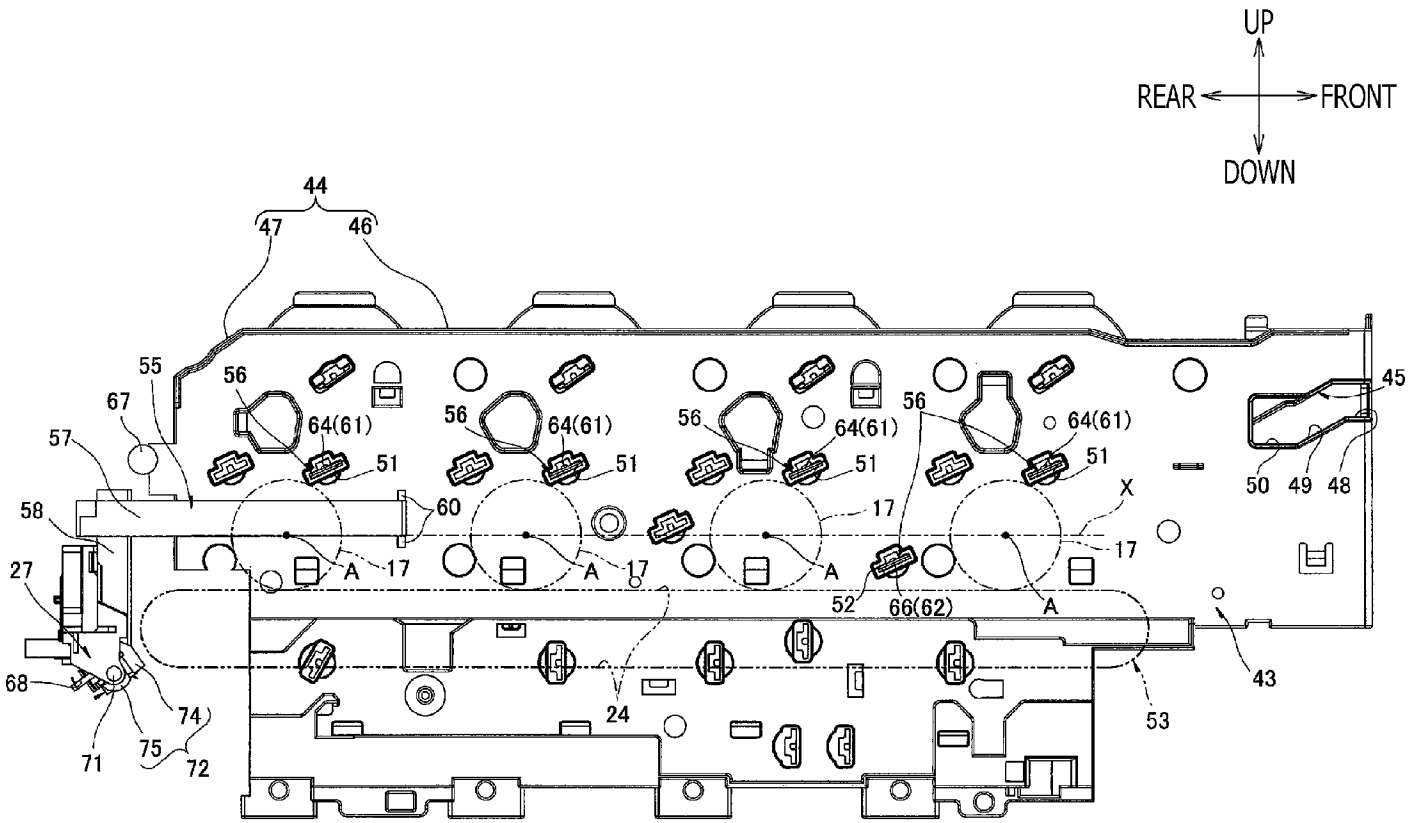
FIG. 4 is a right side view of a second frame shown in FIG. 3.

As shown in FIG. 4, the second frame 43 is formed with the guide part 44, the reference shaft insertion groove 45, a scorotron electrode insertion hole 51 and a cleaning electrode insertion hole 52.

In this embodiment, structures for the guide part 44 and the reference shaft insertion groove 45 are symmetrically provided, in the left and right direction, for the first frame 42 and the second frame 43, respectively, in regard to the shape and alignment. On the other hand, a structure for electrode members 56 which are described later is provided only for the second frame 43. In the following, regarding the first frame 42 and the second frame 43, explanation is made only for the second frame 43, and explanation about the first frame 42 is omitted.

As shown in FIGS. 4 and 7, the guide part 44 is formed on the upper edge surface of the second frame 43, and includes a first guide surface 46 and a second guide surface 47.

As shown in FIG. 4, the first guide surface 46 is formed as a horizontal surface extending, toward the rear side in the front and rear direction, from the front edge to a position corresponding to approximately 9/10 of the entire length of the upper edge surface of the second frame 43 in the front and rear direction.

The second guide surface 47 is formed as an inclined surface which continuously extends from the rear edge of the first guide surface 46 to the rear side and becomes lower toward the rear side. That is, the second guide surface 47 is formed to extend, at the rear edge of the upper surface of the guide part 44, in an intersecting direction which extends from the lower rear portion to the upper front portion and intersects with the front and rear direction.

The reference shaft insertion groove 45 is formed at the front edge portion of the second frame 43, and is formed as a groove recessed downward from the upper portion of the front edge of the second frame 43. The lower edge of the reference shaft insertion groove 45 includes a first horizontal part 48, an inclined part 49 and a second horizontal part 50. The first horizontal part 48 is formed to extend toward the rear side from the front edge of the second frame 43. The inclined part 49 is formed to continuously extend from the rear edge of the first horizontal part 48 and is inclined to become lower toward the rear side. The second horizontal part 50 is formed to continuously extend from the rear edge of the inclined part 49 toward the rear side.

A plurality of scorotron electrode insertion holes 51 are formed, on the rear side of the reference shaft insertion groove 45 of the second frame 43, to have constant intervals therebetween. Specifically, four scorotron electrode insertion holes 51 are formed. Each scorotron electrode insertion holes 51 is formed as a through hole having a rectangular shape when viewed as a side view and extending from the lower rear portion to the upper front portion.

The cleaning electrode insertion hole 52 is formed at a lower rear position of the forefront scorotron electrode insertion hole 51 of the plurality of scorotron electrode insertion holes 51, and is formed as a through hole having a rectangular shape when viewed as a side view and extending from the lower rear portion to the upper front portion.

As shown in FIG. 7, each of the first support frame 80 and the second support frame 81 is formed in a shape of a flat plate and has a rectangular shape extending in the front and rear direction when viewed as a side view. The length in the front and rear direction of the first support frame 80 is larger than the length in the front and rear direction of the first frame 42, and the length in the front and rear direction of the second support frame 81 is larger than the length in the front and rear direction of the second frame 43.

The first support frame 80 is disposed close to the first frame 42 on the left side of the first frame 42 such that the rear end of the first support frame 80 is positioned on the rear side with respect to the rear end of the first frame 42. The second support frame 81 is disposed close to the second frame 43 on the right side of the second frame 43 such that the rear end of the second support frame 81 is positioned on the rear side with respect to the rear end of the second frame 43. Furthermore, the second support frame 81 is provided with a power supply substrate electrically connected to the electrode members 56 which are described later.

(2) Electrode Member

As shown in FIG. 4, the right side wall 41 is provided with the electrode members 56 and a presser member 55.

The electrode members 56 include scorotron electrodes 61 and a cleaning electrode 62.

As shown in FIGS. 3 and 4, a plurality of scorotron electrodes 61 are provided respectively for the plurality of scorotron relay electrodes 82. Specifically, four scorotron electrodes 61 are provided. The scorotron electrode 61 is made of material having conductivity, and is integrally provided with a scorotron spring part 63 and a scorotron contact part 64.

As shown in FIG. 3, the scorotron sprint part 63 is formed in a shape of an air-core coil extending in the left and right direction. As shown in FIG. 7, the scorotron contact part 64 is formed in a shape of a ring protruding to the left side and is formed continuously from the left end of the scorotron spring part 63.

The scorotron electrode 61 is supported by the right side wall 41 such that the scorotron contact part 64 is inserted into the corresponding scorotron electrode insertion hole 51 from the right side and the right end of the scorotron spring part 63 contacts an electrode substrate (not shown). Therefore, the plurality of scorotron electrodes 61 are disposed to have constant intervals in the front and rear direction therebetween and to be parallel with each other in the upper portion of the right side wall 41. The scorotron contact parts 64 protrude toward the left side from the scorotron electrode insertion holes 51, respectively.

The cleaning electrode 62 is provided for the cleaning relay electrode 83. As shown in FIGS. 3 and 4, the cleaning electrode 62 is made of material having conductivity, such as metal, and is provided integrally with a cleaning spring part 65 and a cleaning contact part 66.

As shown in FIG. 3, the cleaning sprint part 65 is formed in a shape of an air-core coil extending in the left and right direction. As shown in FIG. 7, the cleaning contact part 66 is formed in a shape of a ring protruding to the left side and is formed continuously from the left end of the cleaning spring part 65.

As shown in FIG. 4, the cleaning electrode 62 is supported by the right side wall 41 such that the cleaning contact part 66 thereof is inserted into the corresponding cleaning electrode insertion hole 52 from the right side and the right end of the cleaning spring part 65 contacts an electrode substrate (not shown).

Therefore, as shown in FIG. 4, the cleaning electrode 62 is disposed on the lower rear side of the forehand cleaning electrode insertion hole 52 on the right side wall 41. The cleaning contact part 66 protrudes toward the left side from the cleaning electrode insertion hole 52.

(3) Presser Member

As shown in FIGS. 4 and 7, the presser member 55 is provided at the rear end part of the right side wall 41. The presser member 55 includes a swing shaft 60, a lever 57, a joint part 58 and a spring 59.

As shown in FIG. 4, the swing shaft 60 is formed in a cylindrical shape extending in the up and down direction, and is rotatably supported on the left surface of the second frame 43, on the lower front side of the aftermost scorotron electrode 61.

The lever 57 is formed in a shape of a flat plate and has a rectangular shape extending toward the rear side from the central portion in the up and down direction of the swing shaft 60. Therefore, the front end of the lever 57 is swingably supported by the second frame 43. Furthermore, the lever 57 is disposed on the lower side of the aftermost scorotron electrode 61, and is disposed between the plurality of scorotron electrodes 61 and the cleaning electrode 62 when projected in the front and rear direction. That is, the plurality of scorotron electrodes 61 are disposed on the upper side of the lever 57, and the cleaning electrode 62 is disposed on the lower side of the lever 57.

The lever 57 is swingable between a first position where the lever 57 forms an angle of approximately 30° about the swing axis 60 with respect to the second frame 43 as shown in FIG. 5 and a second position where the lever 57 forms an angle of approximately 45° about the swing axis 60 with respect to the second frame 43 as shown in FIG. 7. As described in detail below, the lever 57 is retracted from a movement trajectory of the drum frame 16 in the state where the lever 57 is situated at the first position as shown in FIG. 5. On the other hand, in the state where the lever 57 is situated at the second position as shown in FIG. 7, the lever 57 advances into the movement trajectory of the drum frame 16 such that the lever 57 interferes with the movement trajectory of the drum frame 16.

Figure 9:
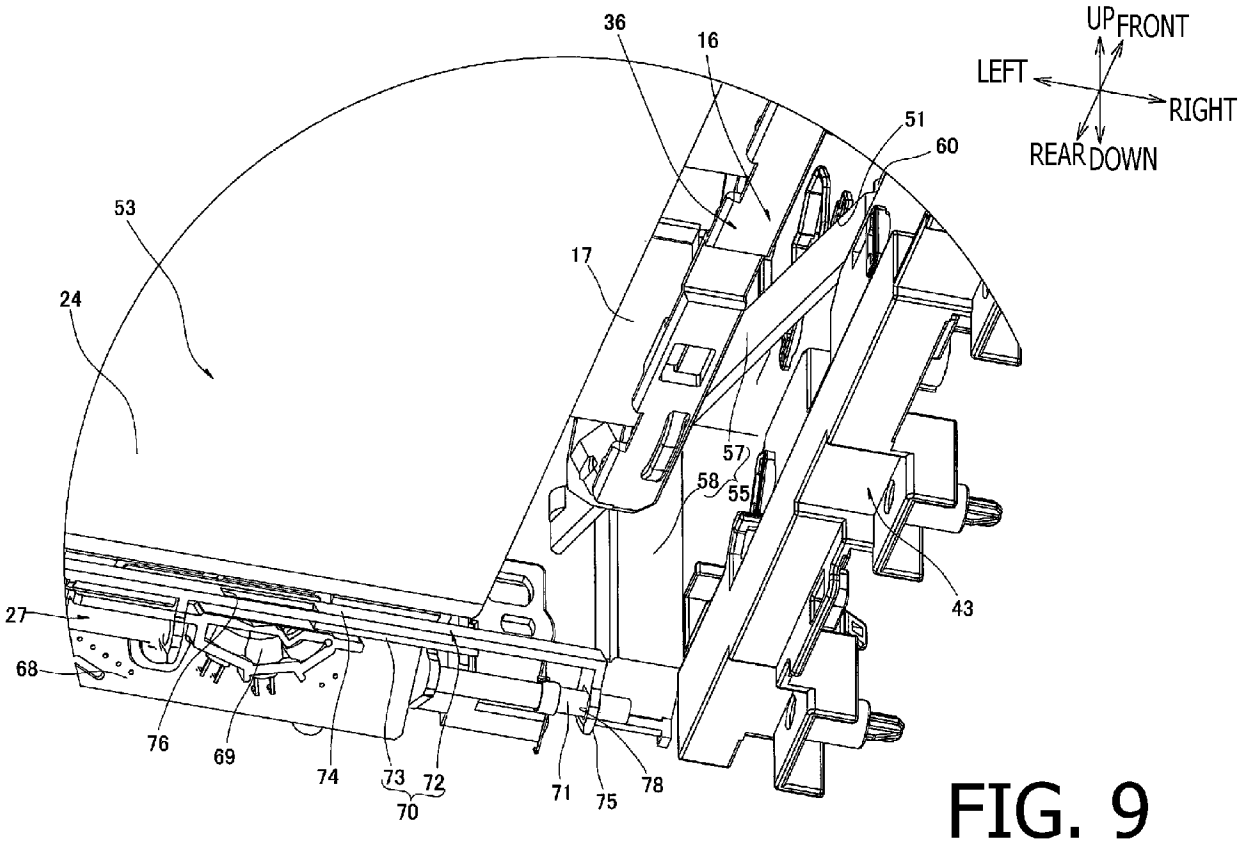
FIG. 9 is an enlarged view of a sensor and shutter shown in FIG. 8.

As shown in FIG. 9, the joint part 58 is formed in a shape of a rod extending in the up and down direction. The joint part 58 is disposed on the right side of the rear end of the lever 57 and on the left side of the rear end of the second support frame 81 so that the joint part 58 contacts the right surface of the rear end part of the lever 57 to be relatively movable with respect to the right surface of the rear end part of the lever 57. Thus, as shown in FIG. 9, the joint part 58 is provided to continuously extend downward from the rear end part of the lever 57. As described later, the lower end of the joint part 58 is coupled to a shaft insertion part 75 on the right side of a shutter 72.

As shown in FIG. 5, the spring 59 is formed in a shape of an air-core coil extending in the left and right direction. The spring 59 is provided to intervene between the right surface of the joint part 58 and the rear end part of the left surface of the second support frame 81. Furthermore, the spring 59 is disposed such that the left end part thereof is fixed to the right surface of the joint part 58, and the right end part thereof is fixed to the left surface of the second support frame 81.

With this configuration, normally the lever 57 is disposed at the second position because of the fact that the rear end part of the lever 57 is pressed toward the left side by the spring 59 via the joint part 58. As shown in FIG. 5, in the state where the drum frame 16 is at the attached position, the lever 57 contacts the rear end part of the right side plate 36 of the drum frame 17, and is disposed at the second position such that the lever 57 is retracted from the movement trajectory of the drum frame 16.

(4) Main Body Reference Shaft

The pair of side walls 41 supports 67 main body reference shaft 67. As shown in FIGS. 3 and 7, the main body reference shaft 67 is formed to have a cylindrical shape extending in the left and right direction, and is installed between central portions in the up and down direction of the rear end parts of the first support frame 81 and the second support frame 82.

(5) Belt Unit and Registration Unit

The main body casing 2 includes the belt unit 33 and a registration unit 27. As shown in FIGS. 4 and 7, the belt unit 53 is disposed to be sandwiched between the first frame 42 and the second frame 43 in the left and right direction, and as shown in FIG. 4 the belt unit 53 is disposed at a position slightly lower than the central portion in the up and down direction of the second frame 43 when projected in the left and right direction.

The registration unit 27 is disposed on the lower rear side of the rear end part of the belt unit 53 between the rear end parts of the first support frame 80 and the second support frame 81. As shown in FIGS. 8 and 9, the registration unit 27 includes sensor holders 68, sensors 69 and cleaning members 70.

As shown in FIG. 8, two sensor holders 68 are provided to have an interval therebetween in the left and right direction such that the sensor holders 68 face the left and right ends of the rear end parts of the conveying belt 24. Each sensor holder 68 is formed in a shape of a flat plate extending in the left and right direction, and is fixed to the main body casing 2. To the sensor holders 68, slide shafts 71 are fixed to protrude outward in the left and right direction from the outer ends of the respective sensor holders 68.

The sensors 69 are held on the sensor holders 68, respectively, so as to face the left and right ends of the rear end parts of the conveying belt 24. Thus, the sensors 69 are disposed to face the conveying belt 24 to have an interval between the sensors 69 and the conveying belt 24.

The cleaning member 70 includes the shutter 72 and a cleaning part 73 for cleaning the sensor 69. The shutter 72 is integrally provided with a body part 74 and the shaft insertion part 75. The body part 74 is formed in a shape of a flat plate and has a rectangular shape extending in the left and right direction when viewed as a front view, and is disposed between the two sensors 69 and the conveying belt 24. The body part 74 is formed with openings 76 respectively corresponding to the sensors 69 at the end parts thereof in the left and right direction.

As shown in FIG. 9, the shaft insertion part 75 is formed in a shape of a flat plate and has a rectangular shape extending to the lower rear portion from each of the left and right ends of the body part 74 when viewed as a side view. The shaft insertion part 75 is formed with a shaft through hole 78 to penetrate therethrough in the left and right direction at a central portion thereof when viewed as a side view. Furthermore, the rear end of the right shaft insertion part 75 and the lower end of the joint part 58 are coupled to each other so as not to be able to relatively move with respect to each other.

Figure 10A:
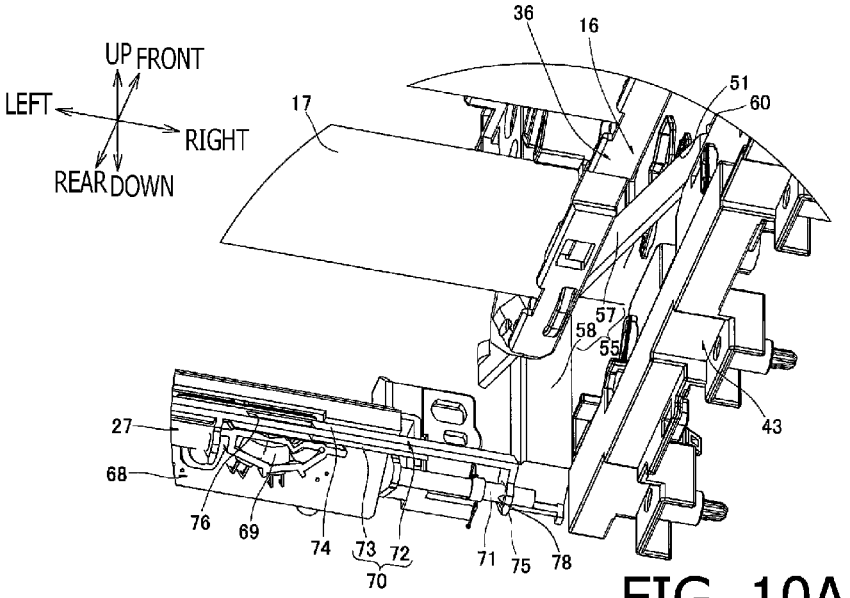
FIGS. 10A and 10B are explanatory illustrations for explaining sliding movement of the shutter shown in FIG. 9 between a detection position and a non-detection position.
Figure 10B:
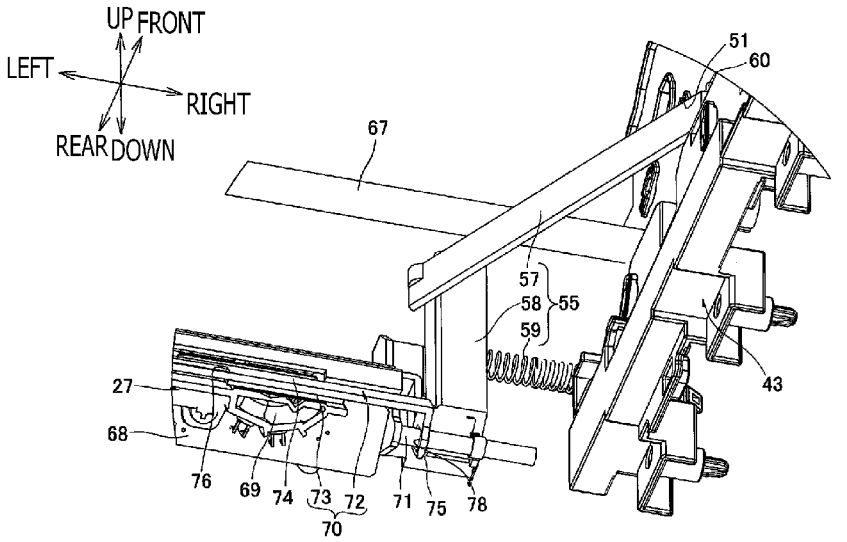

The shutter 72 is slidably supported in the left and right direction with respect to the sensor holder 68 because of the fact that the slide shaft 71 is fitted into the shaft insertion hole 78 with a play. Thus, as described in detail later, the shutter 72 is disposed at a detection position where the opening 76 faces the sensor 69 when the lever 57 is at the first position as shown in FIG. 10A, and is disposed at a non-detection position where the shutter 72 covers the sensor 69 when the lever 57 is at the second position as shown in FIG. 10B, in conjunction with the movement of the leer 57. In FIGS. 10A and 10B, the belt unit 63 is omitted for convenience of explanation.

The cleaning part 73 is made of elastic material, such as sponge, and is formed in a shape of a flat plate extending in the left and right direction as shown in FIG. 10B. The cleaning part 73 is provided on the right side of each opening 76 on the lower rear surface of the body part 74, and faces and contacts the sensor 69 when the shutter 72 is at the non-detection position.

4. Drawing and Attaching of Drum Frame with Respect to Main Body Casing

Hereafter, drawing and attaching of the drum frame 16 with respect to the main body casing 2 are explained with reference to FIGS. 5 to 7. In FIGS. 5 to 7, the drum subunit 90, the front beam 34 and the rear beam 35 are omitted for convenience of explanation.

(1) Drawing of Drum Frame with Respect to Main Body Casing

In order to draw the drum frame 16 from the attached position to the outside of the main body casing 2, first the front cover 6 of the main body casing 2 is rotated from the closed position to the opened position as indicated by a virtual line as shown in FIG. 1, and then is disposed at the opened position. As a result, the opening 5 is opened.

Next, as shown in FIGS. 2 and 5, the drum frame 16 is drawn toward the front side. Then, as shown in FIGS. 5 and 6, the drum frame 16 is moved toward the right side as the drum frame 16 is drawn along the inclined surface of the lever 57. At this moment, the projections 77 at both the left and right sides of the drum frame 16 reach the second guide surfaces 47 of the respective guide parts 44, and the both ends in the left and right direction of the drum side reference shaft 38 reach the inclined parts 49 of the respective reference shaft insertion grooves 45. In addition, engagement of the cutout 40 and the main body reference shaft 67 is released.

Then, the projections 77 at the left and right ends are guided by the respective second guide surfaces 47, and the right and left ends of the drum side reference shaft 38 are guided by the respective inclined parts 49. As a result, the drum frame 16 is moved to the upper front portion. Thus, the plurality of photosensitive drums 17 and the conveying belt 24 are set apart in the up and down direction.

In this case, each of the left and right projections 77 reaches the first guide surface 46 from the second guide surface 47, and each of the left and right ends of the drum reference shaft 38 reaches the first horizontal part 48 from the inclined part 49 of the reference shaft insertion groove 45.

When the drum frame 16 is further drawn toward the front side, the both left and right projections 77 are guided by the respective first guide surfaces 46 as shown in FIGS. 6 and 7, and the drum frame 16 moves to slide in the front and rear direction. Then, the drum frame 16 is pulled out to the outside of the main body casing 2, and is disposed at the drawn position. Thus, the drawing of the drum frame 16 from the attached position to the drawn position is finished.

In the state where the drum frame 16 is disposed at the drawn position, the contacting state of the rear end of the lever 57 and the right side plate 36 of the drum frame 16 is released, and the lever 57 is disposed at the second position where the rear end of the lever 57 advances into the movement trajectory of the drum frame 16 by the pressing force of the spring 59.

At this time, the shutter 72 is pressed toward the left side by the pressing force of the spring 59 as shown in FIG. 10B, and the cleaning part 73 is disposed at the non-detection position where the cleaning part 73 faces and contacts the sensor 69. By further drawing the drum frame 16 to the front side from the drawn position, the drum frame 16 is disposed at a detached position where the drum frame 16 is separated from the main body casing 2.

(2) Attaching of Drum Frame to Main Body Casing

In order to attach the drum frame 16 to the main body casing 2, the inverse procedure of the above described drawing operation is conducted. Specifically, after the front cover 6 is disposed at the opened position, the drum frame 16 is positioned on the front side with respect to the opening 5 of the main body casing 2 so that the projections 77 of the drum side rail parts 37 face the respective guide parts 44 in the front and rear direction as shown in FIGS. 2 and 7.

Then, the drum frame 16 is inserted into the main body casing 2 via the opening 5 from the front side. As a result, each projection 77 is supported on the upper surface of the first guide surface 46 of the guide part 44 from the lower side, and is guided by the first guide surface 46. Thus, the drum frame 16 moves to slide toward the rear side in the state where the plurality of photosensitive drums 17 face with the conveying belt 24 to have a slight interval therebetween in the up and down direction.

Therefore, as shown in FIG. 6, before the projection 77 reaches the second guide surface 47, the rear end of the right side plate 36 of the drum frame 16 contacts the right surface of the lever 57 disposed at the second position. Then, the lever 57 is rotated clockwise when viewed as a plan view as indicated by an arrow, about the swing shaft 60 as a supporting point, against the pressing force of the spring 59, as the drum frame 16 moves to the rear side. As a result, the lever 57 is rotated from the second position to the first position. At this time, the shutter 72 moves to the right side from the non-detection position to the detection position in accordance with rotation of the lever 57. At this time, the cleaning part 73 slides on the sensor 69, and cleans the sensor 69. That is, in accordance with movement of the lever 57 between the first position and the second position, the cleaning part 73 cleans the sensor 69.

On the other hand, as shown in FIG. 6, the rear end of the right side plate 36 is pressed toward the left side by the spring 59 via the lever 57 and the joint part 58. That is, the presser member 55 is configured to press the rear end of the drum frame 16, at least on the front side with respect to the second guide surface 47 of the guide part 44. Then, as the drum frame 16 further moves to the rear side and the rear end of the right side plate 36 approaches the spring 59, the pressing force of the spring 59 being applied to the rear end of the right side plate 36 becomes large. Consequently, the drum frame 16 gradually moves to the left side as the drum frame 16 moves to the rear side.

As the drum frame 16 is moved further to the rear side, the left and right projections 77 reach the respective second guide surfaces 47 from the first guide surfaces 46 of the guide parts 44, and the left and right ends of the drum side reference shaft 38 are inserted into the respective reference shaft insertion grooves 45 and reach the inclined parts 49. Then, the left and right projections 77 are guided by the respective guide surfaces 47, and the left and right ends of the drum side reference shat 38 are guided by the respective inclined parts 49.

As a result, as the drum frame 16 moves toward the rear side, the drum frame 16 moves to the lower side so that the plurality of photosensitive drums 17 gradually approach the conveying belt 24. Then, as shown in FIG. 3, when each projection 77 falls off the rear end of the corresponding second guide surface 47, the cutout 40 receives the main body reference shaft 67 from the front side, and the cutout 40 engages with the main body reference shaft 67. As a result, movement of the drum frame 16 relative to the main body casing 2 is restricted, and the drum frame 16 is positioned in the front and rear direction with respect to the main body casing 2.

Thus, movement of the drum frame 16 from the drawn position to the attached position is finished. That is, the moving direction from the drawn position to the attached position is a direction pointing form the front side to the rear side.

In the state where the drum frame 16 is at the attached position, the drum frame 16 contacts the first frame 42 of the left side plate 36 as shown in FIG. 5. As shown in FIG. 4, the lever 57 presses the rear end of the right side plate 36 (i.e., a position overlapping with the plurality of photosensitive drums 17 when projected in the front and rear direction) toward the left side. Specifically, the lever 57 presses a part defined, in the rear end portion of the right side plate 36, on a virtual line X passing through the axes A of the respective photosensitive drums 17 in the front and rear direction.

When the lever 57 presses the rear end of the right side plate 36 (i.e., the portion between the plurality of scorotron electrodes 61 and the cleaning electrode 62 when projected in the front and rear direction) toward the left side.

As shown FIG. 5, the plurality of scorotron contact parts 64 contact the plurality of scorotron relay electrodes 82, respectively, and press the scorotron relay electrodes 82 toward the left side. In addition, the cleaning contact part 66 contacts the cleaning relay electrode 83, and presses the cleaning relay electrode 83 to the left side. That is, the plurality of scorotron electrodes 61 and the cleaning electrode 62 press, to the left side, the plurality of scorotron relay electrodes 82 and the cleaning relay electrode 83 which are disposed close to the plurality of photosensitive drums 17 on the right side plate 36.

As a result, movement of the drum frame 16 disposed at the attached position relative to the main body casing 2 in the left and right direction is restricted, and the drum frame 16 is positioned in the left and right direction with respect to the first frame 42 (i.e., the main body casing 2).

The scorotron electrode 61 is electrically connected to the corresponding scorotron relay electrode 82, and is electrically connected to the corresponding scorotron charger 18. The cleaning electrode 62 is electrically connected to the corresponding cleaning relay electrode 83, and is electrically connected to the drum cleaning roller 29 via a wiring (not shown).

The lever 57 is disposed at the first position in the state where the rear end of the lever 57 contacts the right side plate 36, and the shutter 72 is disposed at the detection position. In the state where the shutter 72 is at the detection position, the opening 76 of the shutter 72 faces the sensor 69 as shown in FIG. 10B, and the sensor 69 is exposed through the opening 76 when viewed from the conveying belt 24 side.

5. Registration

Hereafter, registration is explained with reference to FIG. 1.

In the printer 1, the registration is performed before the above described paper supplying operation in the image formation. In the registration, first the plurality of photosensitive drums 17 directly transfer register patches to the surface of the conveying belt 24. When the sensor 69 faces the register patch in accordance with rotation of the conveying belt 24, the sensor 69 detects the register patch via the opening 76 as shown in FIG. 10B. Then, a CPU (not shown) provided in the printer 1 judges, for example, a color shift of each color, based on the detection result by the sensor 69. On the other hand, the register patch is scraped off by the belt cleaning roller 28 when the register patch faces the belt cleaning roller 28. Thus, the conveying belt 24 is cleaned by the belt cleaner 26.

6. Advantageous Effect (1) As shown in FIG. 5, in the printer 1, the lever 57 presses the drum frame 16 disposed at the attached position to the left side. Therefore, the relative movement of the drum frame 16 disposed at the attached position is restricted in the left and right direction. As a result, the relative movement of the plurality of photosensitive drums 17 supported by the drum frame 16 is restricted in the left and right direction via the drum frame 16.

As shown in FIG. 4, the lever 57 presses the right side plate 36 at the part overlapping with the plurality of photosensitive drums 17 when projected in the front and rear direction. Therefore, the pressing force of the lever 57 securely acts on the plurality of drums 17 via the drum frame 16.

As a result, the relative movement of the plurality of photosensitive drums 17 in the left and right direction with respect to the main body casing 2 can be restricted, and thereby it becomes possible to enhance the positioning accuracy of the plurality of photosensitive drums 17 with respect to the main body casing 2 in regard to the left and right direction.

Furthermore, the lever 57 presses the rear end of the right side plate 36 of the drum frame 16 in the state where the drum frame 16 is disposed at the attached position. Therefore, when the drum frame 16 moves between the drawn position and the attached position, the drum frame 16 can be prevented from being pressed by the lever 57. Consequently, smooth movement of the drum frame 16 between the drawn position and the attached position can be secured.

Therefore, in the printer 1, the position accuracy of the plurality of photosensitive drums 17 in the left and right direction with respect to the main body casing 2 can be enhanced, while securing the smooth movement of the drum frame 16 between the drawn position and the attached position.

(2) Furthermore, as shown in FIG. 4, the lever 57 presses the right side plate 36 at the position overlapping with the virtual line X, the pressing force of the lever 57 securely acts on the axes A of the respective photosensitive drums 17.

Therefore, the relative movement of the plurality of photosensitive drums 17 in the left and right direction with respect to the main body casing 2 can be securely suppressed, and the positioning accuracy of the plurality of photosensitive drums 17 with respect to the main body casing 2 can be securely enhanced.

(3) As shown in FIGS. 4 and 5, the plurality of scorotron electrodes 61 press, to the left side, the scorotron relay electrodes 82 respectively provided on the right side plate 36 at the positions close to the respective photosensitive drums 17. In addition, the cleaning electrode 62 presses, to the left side, the cleaning relay electrode 83 provided on the right side plate 36 at the position close to the foremost photosensitive drum 17.

Therefore, the relative movement of the drum frame 16 in the left and right direction with respect to the main body casing 2 can be suppressed more securely. As a result, the position accuracy of the plurality of photosensitive drums 17 with respect to the main body casing can be further enhanced.

(4) As shown FIG. 5, the lever 57 presses, to the left side, the drum frame 16 disposed at the attached position. Therefore, the relative movement of the drum frame 16 disposed at the attached position in the left and right direction with respect to the main body casing 2 can be restricted. As a result, the relative movement of the plurality of photosensitive drums 17 supported by the drum frame 16 in the left and right direction is restricted.

As shown in FIG. 4, the lever 57 presses the rear end of the right side plate 36 of the drum frame 16 disposed at the attached position. Therefore, it is possible to prevent the drum frame 16 from being pressed by the lever 57 while the drum frame 16 moves between the drawn position and the attached position.

Therefore, the positioning accuracy of the plurality of photosensitive drums 17 in the left and right direction with respect to the main body casing 2 can be enhanced, while securing the smooth movement of the drum frame 16 between the drawn position and the attached position.

On the right side wall 41 of the main body casing 2, the scorotron electrodes 61 and the cleaning electrode 62 are provided as electrode members 56. Therefore, it is possible to supply power to the drum frame 16 from a power source substrate (not shown) via the scorotron electrodes 61 and the cleaning electrode 62.

The lever 57 presses the right side plate 36 of the drum frame 16 at the attached position at the portion between the plurality of scorotron electrodes 61 and the cleaning electrode 62 when projected in the front and rear direction. Therefore, effective disposition of the scorotron electrodes 61, the cleaning electrode 62 and the lever 57 can be achieved.

Therefore, in the state where the drum frame 16 is disposed at the attached position, the effective disposition of the scorotron electrodes 61, the cleaning electrode 62 and the lever 57 can be secured while supplying electric power to the drum frame 16.

(5) As shown in FIG. 5, the first frame 42 made of metal is disposed on the left side with respect to the drum frame 16 disposed at the attached position. Therefore, the drum frame 16 disposed at the attached position is pressed toward the first frame 42 by the lever 57. As a result, it becomes possible to cause the drum frame 16 disposed at the attached position to contact the first frame 42 having rigidity higher than that of the second frame 43, and thereby it becomes possible to position the drum frame 16 with respect to the first frame 42.

Consequently, it becomes possible to enhance the positioning accuracy of the drum frame 16 with respect to the main body casing 2, and thereby it becomes possible to further enhance the positioning accuracy of the plurality of photosensitive drums 17 with respect to the main body casing 2.

(6) As shown in FIG. 1, the printer 1 includes the conveying belt 24. Therefore, it is possible to transfer a color image from the plurality of photosensitive drums 17 to the sheet S being conveyed by the conveying belt 24 by causing the toner of the respective colors to be held on the surfaces of the respective photosensitive drums 17.

(7) Since, as shown in FIGS. 5 to 7, the guide part 44 guides movement of the drum frame 16 from the drawn position to the attached position, it is possible to secure smooth movement of the drum frame 16 from the drawn position to the attached position.

Since the guide part 44 includes the second guide surface 47, it is possible to cause the plurality of photosensitive drums 17 to adequately depart from the upper surface of the conveying belt 24 until the projection 77 reaches the front end of the second guide surface 47 during movement of the drum frame 16 from the drawn position to the attached position. As a result, it becomes possible to prevent the plurality of photosensitive drums 17 from sliding on the conveying belt 24.

On the other hand, when the drum frame 16 reaches the front end part of the second guide surface 47, the projection 77 of the drum frame 16 is guided by the second guide surface 47, and the plurality of photosensitive drums 17 face and contact the conveying belt 24. Therefore, in the state where the drum frame 16 is disposed at the attached position, the plurality of photosensitive drums 17 can be caused to face and contact the conveying belt 24.

As a result, it becomes possible to cause the plurality of photosensitive drums 17 to face and contact the conveying belt 24 in the state where the drum frame 16 is disposed at the attached position, while preventing the plurality of photosensitive drums 17 and the conveying belt 24 from sliding with respect to each other, during movement of the drum frame 16.

Since the lever 57 presses the drum frame 16 at least on the front side of the second guide surface 47, the pressing by the lever 57 starts before the projection 77 reaches the second guide surface 47. Therefore, the drum frame 16 moves toward the rear side, and is pressed toward the left side by the lever 57. As a result, it becomes possible to cause the drum frame 16 to gradually move to the left side as the drum frame 16 is moved toward the rear side. Consequently, it becomes possible to move the drum frame 16 stably toward the left side.

(8) Furthermore, as shown in FIG. 9, the toner transferred from the plurality of photosensitive drums 17 to the conveying belt 24 can be detected by the sensor 69. Therefore, it is possible to check whether the toner image can be securely transferred to the sheet S being conveyed by the conveying belt 24 during image formation. Namely, the printer 1 is able to judge, for example, color shift, based on the detection result by the sensor 69.

By moving the lever 57 between the first position and the second position by moving the drum frame 16 between the drawn position and the attached position, it becomes possible to cause the cleaning part 73 to clean the sensor 69. Therefore, by moving the drum frame 16 between the drawn position and the attached position, it is possible to cause the cleaning part 73 to clean the sensor 69 without the need for operating the cleaning member 70.

As a result, it becomes possible to prevent the detection accuracy of the sensor 69 from deteriorating, while facilitating the cleaning work for the sensor 69.

(9) As shown in FIG. 3, the presser member 55 includes the lever 57, the joint part 58 and the spring 59, the rear end of the lever 57 is pressed toward the left side by the spring 59 via the joint part 58.

Therefore, as shown in FIG. 7, the rear end of the lever 57 can be normally positioned to advance into the movement trajectory of the drum frame 16, and thereby the lever 57 can be normally disposed at the second position.

As shown in FIGS. 3 and 5, since the rear end of the lever 57 contacts the rear end of the right side plate 36 in the state where the drum 16 is disposed at the attached position, the lever 57 is disposed at the first position which is retracted from the movement trajectory of the drum frame 16. As a result, it becomes possible to cause the lever 57 to securely rotate between the first position and the second position, while normally disposing the lever 57 at the second position.

As shown in FIGS. 10A and 10B, the cleaning member 70 includes the shutter 72 coupled to the lower end of the joint part 58, and the cleaning part 73 which is provided on the shutter 72 to clean the sensor 69. Therefore, it becomes possible to securely engage the movement of the lever 57 between the first position and the second position with the movement of the shutter 72 between the detection position and the non-detection position. That is, the movement of the drum frame 16 between the drawn position and the attached position can be securely engaged with the movement of the shutter 72 between the detection position and the non-detection position.

Furthermore, the cleaning part 73 cleans the sensor 69 since the shutter 72 moves between the detection position and the non-detection position. Therefore, it is possible to cause the cleaning part 73 to clean the sensor 69 while moving the shutter 72 between the detection position and the non-detection position by moving the drum frame 16 between the drawn position and the attached position.

7. Variations

It is understood that the above described printer 1 is an example of an image forming apparatus according to the invention, and the present invention is not limited to the above described embodiment.

In the above described printer 1, the drum frame 16 supports the photosensitive drums 17, and the development cartridges 15 are detachably attachable to the drum frame 16.

However, a drum cartridge supporting the photosensitive drums 17 may be detachably attachable to the drum frame 16. A process cartridge in which the development cartridge 15 and the drum cartridge are integrally provided may be detachably attachable to the drum frame 16. Such a configuration also enables the photosensitive drums 17 to be supported by the drum frame 16.

The above described printer 1 is configured as a color printer of a direct tandem type including the conveying belt 24; however, the printer 1 may be configured as a color printer of an intermediate transfer type having an intermediate transfer belt to which a toner image of the photosensitive drum 17 is transferred primarily and from which the toner image is transferred secondarily to the sheet S.

In the above described printer, the first frame 42 is made of metal, and the second frame is made of resin; however, each of the first frame 42 and the second frame 43 may be made of metal.

In the above described printer 1, the lever 57 and the joint part 58 contact with each other to be able to relatively move; however, the rear end of the lever 57 may be coupled to the joint part 58 to be relatively rotatable, and the front end of the lever 57 may be supported by the second frame 43 so as to be slidable in the front and rear direction and relatively rotatable.

In the above described printer 1, the lever 57 of the presser member 55 contacts the drum frame 16 disposed at the attached position in the state where the lever 57 is at the first position, and presses the drum frame 16.

However, the presser member 55 may further include an additional component of which movement is engaged with the movement of the lever 57, and the additional component may contact the drum frame 16 disposed at the attached position in the state where the lever 57 is disposed at the first position. In this case, the lever 57 presses the drum frame 16 disposed at the attached position via the additional component.

What is claimed is:

1. An image forming apparatus, comprising:

a housing having an opening;

a drawer member configured to support a plurality of photosensitive drums disposed to have intervals therebetween to be parallel with each other, and to be movable in an arrangement direction of the plurality of photosensitive drums such that the drawer member moves between an attached position where the drawer member is attached in the housing and a drawn position where the drawer member is drawn to an outside of the housing from the attached position via the opening; and a presser member that is provided in the housing and is configured to press the drawer member toward one side in an axial direction in which an axis of each of the plurality of photosensitive drums extends, wherein the presser member presses a downstream end part of the drawer member defined in a moving direction of the drawer member pointing from the drawn position to the attached position, at a position overlapping with the plurality of photosensitive drums in the arrangement direction, in a state where the drawer member is situated at the attached position.

2. The image forming apparatus according to claim 1, wherein the presser member presses the downstream end part of the drawer member defined in the moving direction, at a position overlapping with axes of the plurality of photosensitive drums in the arrangement direction, in the state where the drawer member is situated at the attached position.

3. The image forming apparatus according to claim 1, wherein the housing comprises a pressing member configured to press the drawer member toward the one side in the axial direction, at positions close to respective ones of the plurality of photosensitive drums, in the state where the drawer member is situated at the attached position.

4. An image forming apparatus, comprising:

a housing having an opening;

a drawer member configured to support a plurality of photosensitive drums disposed to have intervals therebetween to be parallel with each other, and to move between an attached position where the drawer member is attached in the housing and a drawn position where the drawer member is drawn to an outside of the housing from the attached position via the opening;

a presser member that is provided in the housing and is configured to press the drawer member toward one side in an axial direction in which an axis of each of the plurality of photosensitive drums extends, wherein the presser member presses a downstream end part of the drawer member defined in a moving direction of the drawer member pointing from the drawn position to the attached position, in a state where the drawer member is situated at the attached position; and an electrode member that is provided in the housing and is configured to electrically connected to the drawer member situated at the attached position, wherein the electrode member comprises:

a first electrode disposed on one side in an orthogonal direction orthogonal to both of the axial direction and the moving direction of the drawer member pointing from the drawn position to the attached position, with respect to the presser member, in the state where the drawer member is situated at the attached position; and a second electrode disposed on the other side in the orthogonal direction, with respect to the presser member, in the state where the drawer member is situated at the attached position.

5. The image forming apparatus according to claim 4, wherein:

the housing comprises a first frame and a second frame disposed to have an interval therebetween in the axial direction such that the drawer member situated at the attached position is sandwiched between the first frame and the second frame;

the first frame is disposed on the one side in the axial direction with respect to the drawer member, and is made of metal; and the second frame is disposed on the other side in the axial direction with respect to the drawer member, and is made of resin.

6. The image forming apparatus according to claim 4, wherein the housing comprises a belt member disposed to face the plurality of photosensitive drums in the state where the drawer member is situated at the attached position.

7. The image forming apparatus according to claim 6, wherein:

the housing comprises a guide part configured to guide movement of the drawer member from the drawn position to the attached position;

the guide part comprises an attachment guide part formed to extend in a direction intersecting with the moving direction, in a downstream end portion of the housing defined in the moving direction, and to guide the drawer member such that the belt member and each of the plurality of photosensitive drums approach each other; and the presser member is configured to press the drawer member, at least on an upstream side in the moving direction with respect to the attachment guide part.

8. The image forming apparatus according to claim 6, wherein the housing comprises:

a sensor that is disposed to face the belt member and is configured to detect developer transferred to the belt member from the plurality of photosensitive drums; and a cleaning member configured to clean the sensor, wherein:

the presser member is configured to move between a first position where the presser member contacts the drawer member and is positioned to be retracted from a movement trajectory of the drawer member in the state where the drawer member is situated at the attached position, and a second position where a contacting state of the presser member with the drawer member is released and the presser member advances into the movement trajectory of the drawer member; and the cleaning member is coupled to the presser member and is configured to clean the sensor in accordance with movement of the presser member between the first position and the second position.

9. The image forming apparatus according to claim 8, wherein the presser member comprises:

a presser part that is formed to extend in the moving direction and to be swingably supported by the housing at an upstream end part of the presser part defined in the moving direction;

a joint part formed to continuously extend from a downstream end part of the presser part defined in the moving direction, in the orthogonal direction orthogonal to both of the axial direction and the moving direction; and a pressing member that is disposed between the joint part and the housing and is configured to press, via the joint part, the downstream end part of the presser part toward the one side in the axial direction, wherein the cleaning member comprises:

a shutter that is disposed between the sensor and the belt member, and is formed to be coupled to the joint part and to extend in the axial direction; and a cleaning part that is provided on the shutter and is configured to clean the sensor by contacting the sensor, wherein:

the shutter is configured to have an opening formed to expose the sensor when the opening faces the sensor;

the shutter is configured to be slidable in the axial direction between a detection position where the opening faces the sensor when the presser member is at the first position and a non-detection position where the sensor is covered with the shutter when the presser member is at the second position; and the cleaning part cleans the sensor by movement of the shutter between the detection position and the non-detection position.

* * * * *